United States Patent [19]

Mathews

[11] Patent Number: 4,590,974

[45] Date of Patent: May 27, 1986

[54] BEVERAGE DISPENSER

[75] Inventor: Robert B. Mathews, Salt Lake City, Utah

[73] Assignee: Carb-A-Drink International, Inc., Salt Lake City, Utah

[21] Appl. No.: 564,397

[22] Filed: Dec. 22, 1983

[51] Int. Cl.[4] ..... B65B 3/04

[52] U.S. Cl. ..... 141/1; 141/86; 141/247; 141/286; 141/337; 222/108; 222/173; 222/461

[58] Field of Search ..... 222/460, 461, 108, 109, 222/318, 129, 129.1, 135, 173, 189, 136, 144.5; 99/275; 137/12.5; 62/390; 141/88, 337, 364, 239, 247, 331, 361, 286, 1, 2, 18, 86, 87, 311 R, 340–343, 332, 372, 369, 370, 377, 272; 604/190, 199

[56] References Cited

U.S. PATENT DOCUMENTS

| | | | |
|---|---|---|---|
| 60,344 | 12/1866 | Devoe | 222/461 X |
| 537,434 | 4/1895 | Berner | 222/108 |
| 545,915 | 9/1895 | Russell | 141/332 |
| 679,295 | 7/1901 | Chandler | 222/461 X |
| 991,664 | 5/1911 | Strasburger | 141/377 X |
| 1,521,928 | 1/1925 | Campbell | 141/372 X |
| 1,883,787 | 10/1932 | Head et al. | 222/108 X |
| 2,321,844 | 6/1943 | Nicholson | 222/108 X |
| 2,536,419 | 1/1951 | Brunell | 141/341 |
| 2,558,522 | 6/1951 | Knapp | 222/144.5 X |
| 2,598,665 | 6/1952 | Levings | 222/108 X |
| 2,623,523 | 12/1952 | Benson | 222/461 X |
| 2,812,117 | 11/1957 | Butkus et al. | 141/311 X |
| 2,827,931 | 3/1958 | Melvin | 141/331 |
| 2,934,243 | 4/1960 | Metzger | 222/173 X |
| 2,977,025 | 3/1961 | Scott | 222/108 |
| 3,193,143 | 7/1965 | Maieli | 222/144.5 X |
| 3,200,997 | 8/1965 | Creswick | 141/369 X |
| 3,289,948 | 12/1966 | Fuerst | 222/129 X |
| 3,732,734 | 5/1973 | Avakian | 73/425.6 |
| 4,335,730 | 6/1982 | Griffin | 141/331 X |
| 4,338,984 | 7/1982 | Kronberg et al. | 141/331 |
| 4,469,150 | 9/1984 | Grimaldi | 141/361 X |

FOREIGN PATENT DOCUMENTS

| | | | |
|---|---|---|---|
| 881973 | 5/1943 | France | 141/331 |
| 24505 | of 1894 | United Kingdom | 141/88 |

*Primary Examiner*—Joseph J. Rolla
*Assistant Examiner*—Kevin P. Shaver
*Attorney, Agent, or Firm*—George H. Mortimer

[57] ABSTRACT

A self-service beverage dispenser which includes a cabinet, a plurality of dispensing heads mounted in upper portion of the cabinet and a support for bottles to receive the beverages that are dispensed from the dispensing heads. The support for the bottles includes a trough carried by the cabinet beneath the dispensing heads to receive and to carry away beverages spilled into the trough and a perforated positioning platform for a succession of bottles forming a screen cover for the spill trough. A support for a succession of bottles to receive beverage from a dispensing head. Optionally a positioning bracket secured to the cabinet is provided beneath each nozzle for holding a bottle with the filling opening in the neck thereof out of direct alignment of the gravity induced stream of beverage flowing from a dispensing head. Disposable funnels are provided for surrounding a nozzle at its upper, larger end and for entering the filling opening of the bottle supported on said perforated platform at its lower, smaller end, thus providing a flow path for beverage flowing from a dispensing head into the open end of the bottle to be filled.

9 Claims, 4 Drawing Figures

BEVERAGE DISPENSER

BACKGROUND OF THE INVENTION

1. Field of the Invention

The present invention pertains to beverage dispensing and beverage dispensers and is particularly concerned with a method of and apparatus for dispensing multiple beverages from a single unit, into a container.

2. Prior Art

Beverage dispensers, and even multiple head beverage dispensers, are well known. The multiple heads allow simultaneous filling of more than one container and may provide for the dispensing of more than one type of beverage from the dispenser unit. Dispensing units, adapted to dispense carbonated beverages and the like, are shown in U.S. Pat. Nos. 2,643,866 3,011,681, and 3,058,620. The beverage dispensers shown in these patents may all be entirely satisfactory for their intended purposes of dispensing pressurized beverages into containers. However, it has recently been found desirable to use dispensing units in retail stores to dispense beverages directly into containers provided by customers and to permit the customers to fill the containers themselves. This has allowed the retailer to market the beverages at reduced rates since there is no costly packaging involved and since the customer provides the labor necessary to fill the container.

In dispensing beverages directly into customers' containers, it is necessary that the containers be filled quickly so that delays are not encountered by customers trying to fill their containers. Also, since the containers being filled are cared for and cleaned by the customer, the retailer has no control over the degree of cleanliness of the container. It is necessary, for sanitation purposes, that the container not be allowed to come in contact with dispensing nozzle of the dispensing unit.

U.S. Pat. No. 67,869, discloses the use of a funnel suspended from a dispensing nozzle to direct flow of a beverage into a container. The funnel shown in the patent is intended to be filled with ice, and the beverage, after passing through the ice, is dispensed from the bottom of the funnel into a container. U.S. Pat. No. 2,623,523, discloses an anti-infection spreading shield in the form of a disposable funnel that is positioned between the dispensing body and a persons nostrils so that the dispensing body will not be contaminated and can be safely used to dispense medication to more than one individual.

To the best of my knowledge, there has not heretofore been developed a beverage dispensing system that uses a disposable funnel to interconnect a dispensing nozzle of a unit and a container so that contamination of a nozzle does not occur during the filling of the container.

Also, to the best of my knowledge there has not heretofore been a dispensing unit for beverages and the like, that will insure rapid filling of a container positioned to receive the beverage while insuring that sanitary conditions are maintained.

OBJECTS OF THE INVENTION

Principal objects of the invention are to provide a beverage dispenser for carbonated beverages, and the like, that will conveniently allow consumers to rapidly fill their own containers and to do so in a sanitary manner.

Other objects of the invention are to provide a beverage dispenser that uses a disposable, economical sanitation shield, as a barrier, between the dispensing head of the beverage dispensing unit and a container positioned beneath the dispensing head.

Still other objects are to provide a carbonated beverage dispenser having means for tilting a receiving container to provide optium speed of filling consistent with minimizing foaming in the container, and means to prevent inadvertent contact of the container with the dispenser nozzle of dispensing unit.

FEATURES OF THE INVENTION

Principal features of the apparatus aspect of the invention include a beverage dispenser having at least one, and preferably a series of dispensing heads, mounted on the cabinet of a beverage dispensing unit. The dispensing heads are positioned above a spill trough, and the spill trough is equipped with a perforated positioning platform that serves as a screen cover for the trough while at the same time providing a support platform for a container positioned to receive beverage from each nozzle.

A positioning bracket is fixed to the cabinet of the dispensing unit and cooperates with the positioning platform to hold the container at a proper angle for receiving dispensed beverages from the nozzle at a highest possible rate of flow without excessive foam generation. The positioning bracket also prevents direct alignment of the container with the nozzle so that contamination of the nozzle will not occur as a result of contact of the nozzle with the container.

Principal features of the method of the invention include the dispensing of the beverage from a dispensing nozzle through a disposable, sanitary funnel into a customer's container, which may not be sanitary, preventing contact of the container with the dispensing nozzle to avoid contaminating it, and placing the container in filling position on a support with its axis at an angle for optimum speed of filling consistent with minimum foaming of a foamable beverage.

Other objects and features of the invention will become apparent from the following detailed description and drawings disclose what are presently contemplated as being the best mode of the invention.

THE DRAWING

In the drawing:

FIG. 1 is a front elevation view of a beverage dispensing unit of the invention;

FIG. 2, a top plan view;

FIG. 3, a side elevation view; and

FIG. 4, a greatly enlarged vertical section view, taken on the line 4—4 of FIG. 1.

DETAILED DESCRIPTION

Figure 1:
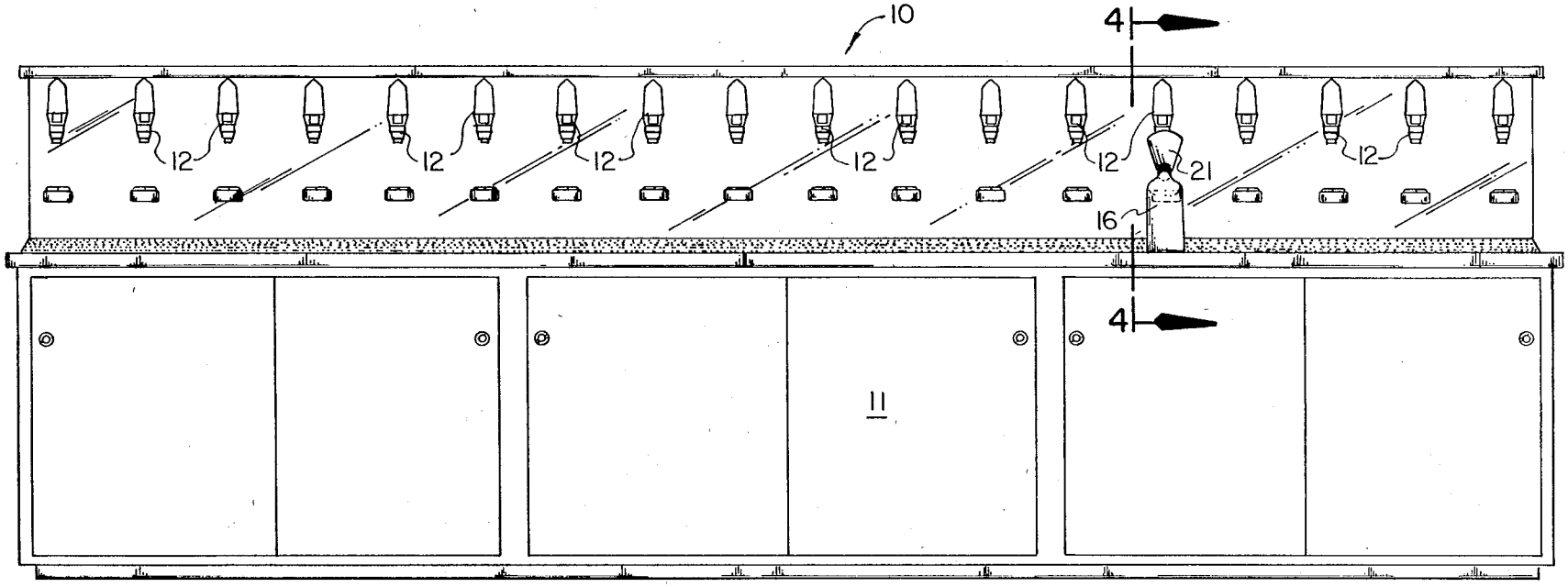
Figure 2:
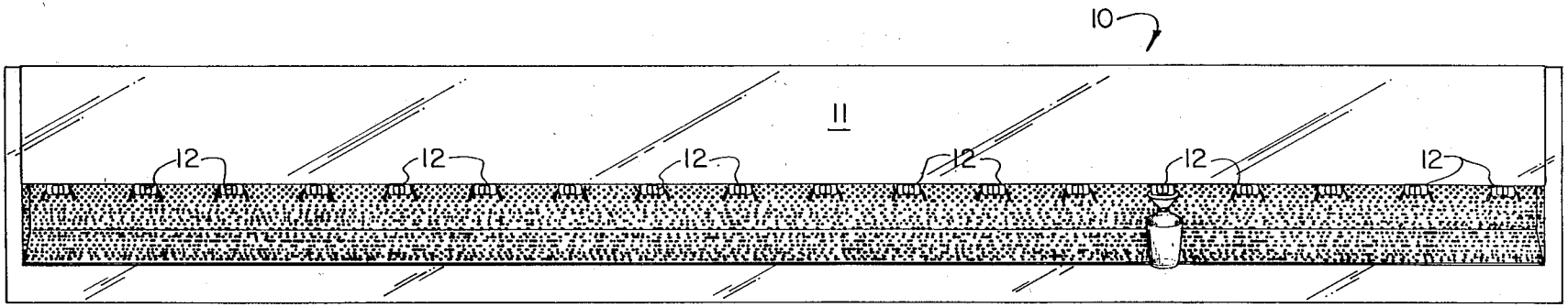

Referring now to the drawings:

In the illustrated preferred embodiment, the dispensing unit of the invention, shown generally at 10, includes a cabinet 11 having spaced dispensing heads 12 extending along the length thereof. As shown, twenty dispensing heads are provided, but it is to be understood that more or fewer heads can be used, that more than one dispensing nozzle can be provided for each head and that more than one beverage can be dispensed through a single nozzle. The use of multiple nozzles for a single dispensing head and apparatus for dispensing plural fluids from a single nozzle are well known, and will not be further described.

The dispenser unit 10 further includes a spill trough 13, formed from sheet metal, plastic, or the like, and extending the length of the dispenser unit, beneath the dispenser heads 12.

The spill trough receives spilled beverages and carries them to a central or end collection point in the trough, from which the spilled beverage is discharged to a collection vessel, not shown.

Figure 4:
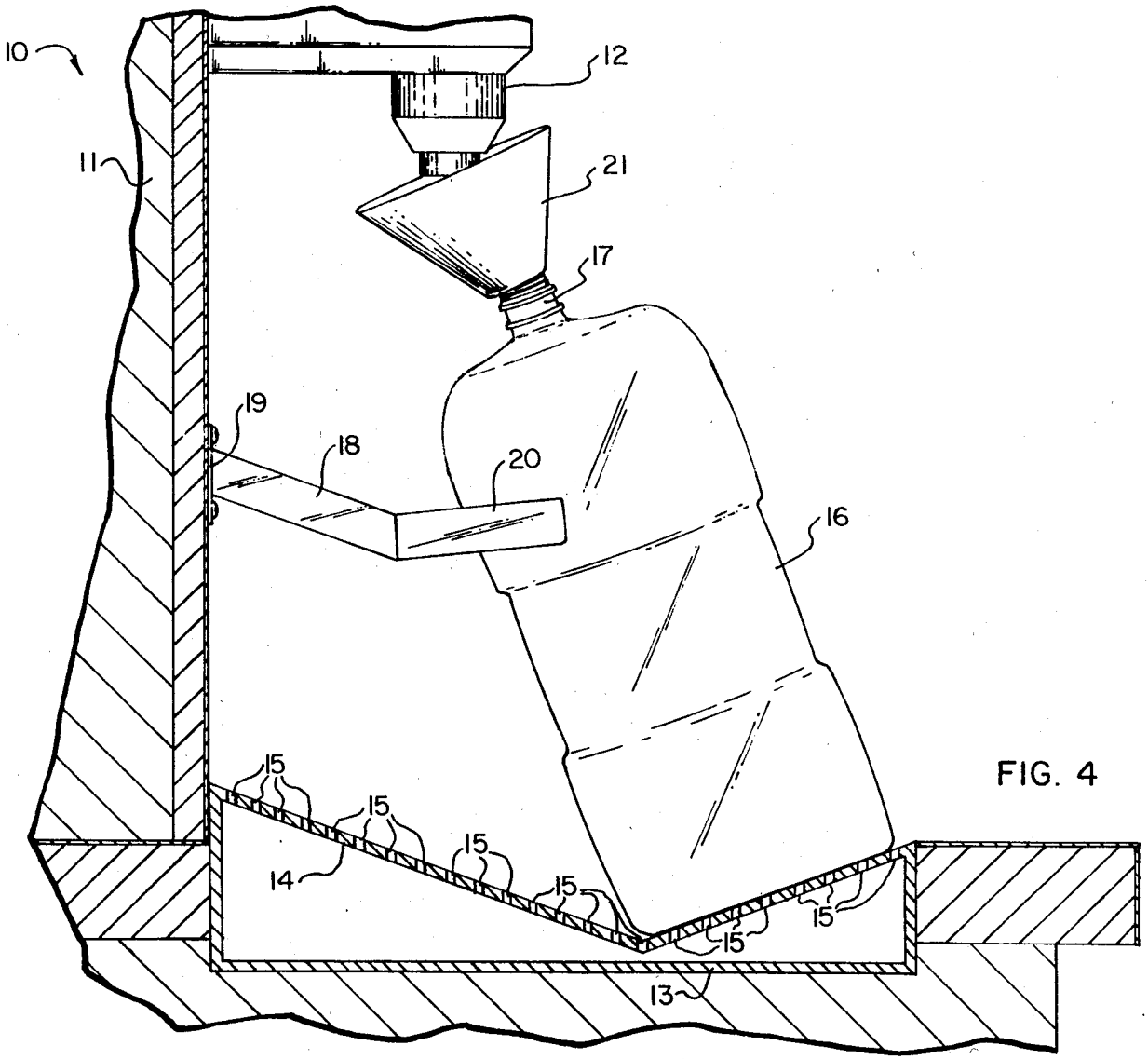
Figure 3:
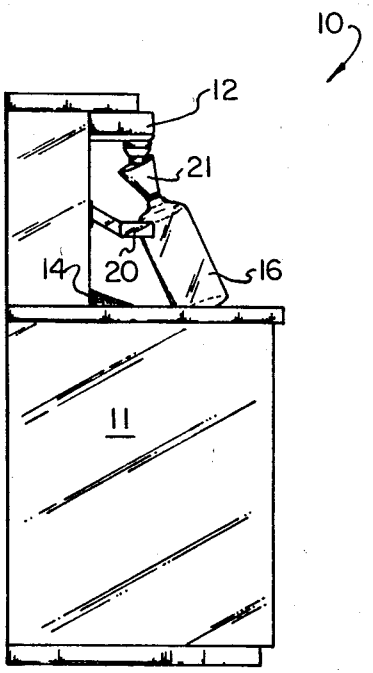

A positioning platform 14 having perforations 15 therein forms a screen cover for the trough 13 and properly positions a container to be filled from the dispensing head 12, as will be further described. As shown best in FIG. 4, the positioning platform is of generally V-shaped cross sectioned configuration. Again, as seen in FIG. 4, a container 16 will rest on the positioning platform 14 so that its top 17 is inclined toward the dispensing nozzle 12.

A positioning bracket 18 is affixed to the cabinet 11 beneath each dispensing nozzle 12. The bracket extends from the cabinets sufficiently far to engage the container 16 and to hold the container such that the top thereof is inclined toward the dispensing nozzle 12, but is not directly beneath the dispensing nozzle and is not in the discharge path the liquid discharged from the dispensing nozzle would normally take under the influence of gravity if no means were used to divert the beverage into the filling opening of the container. The bracket 18 includes a base 19 that is affixed to the cabinet 11 in a generally U-shaped collar 20 that is adapted to receive and to extend partially around the container 16. As shown, the container 16 is preferably a conventional two-liter bottle of the type commercially used for the sale and distribution of carbonated beverages.

A sanitary, disposable means, e.g., a funnel 21, made of paper or the like, is used as the sanitation shield to direct liquid from the downward discharging nozzle 12 into the open upper end 17 of the container 16.

In carrying out the method of the invention, a customer places a container 16 on the positioning platform 14 so that the axis of a bottle on the platform is at the optimum amgle with respect to the direction of flow of the beverage from the nozzle 12 for adequate rate of filling consistent with minimum foaming of a foamable beverage and with the open or filling end 17 pointed toward but out of the direct path of flow of beverage from the dispensing nozzle which is far enough above it that contact of the container with the nozzle during its placement on and removal from the platform is highhly improbable. The container is rested within the collar 20 of bracket 18 to stabilize it. The user takes a sanitary funnel from a conveniently located supply of them, and slips the large end of the funnel 21 up over the dispensing nozzle 12 and then lowers the funnel until the small end of the funnel extends into the open end 17 of container 16. When the funnel is released, the large end will then rest against dispensing nozzle 12. However, it has been found advisable for the customer to tilt the funnel slightly forward so as to direct the beverage against the lower sloping wall of the container 16. The funnel is discarded after use.

The bracket 18 entends beyond the discharge path of liquid discharged from nozzle 12 and prevents vertical positioning of container beneath the nozzle. Thus, the bracket serves as a means to insure proper positioning of the container for rapid filling while also helping to prevent contact of the container inlet with the nozzle.

Although a preferred form of my invention has been herein disclosed, it is to be understood that the present disclosure is by way of example and that variations are possible without departing from the subject matter coming within the scope of the following claims, which subject matter I regard as my invention.

I claim:

1. The method of dispensing beverage through a nozzle that must be kept sanitary to a customer's container, which has a filling opening and which may be contaminated without contaminating the nozzle from contact with the container which comprises placing a customer's container in filling position on a support spaced from the nozzzle a sufficient distance that the danger of contact of the container with the nozzle during placement of the container on and removal of the container from the support is negligible, inserting a sanitary disposable paper means between the nozzle and the filling opening of the container, dispensing beverage through the nozzle and disposable paper means into the container until it is filled with the desired quantity thereof, removing the container from the filling position, and discarding the disposable paper means.

2. The method of dispensing beverage as in claim 1, wherein the beverage is foamable and the container is placed in filling position with its axis at an optimum filling angle for as rapid a rate of flow as is consistent with low foaming of the beverage in the bottle container.

3. A beverage dispenser comprising:

(A) a cabinet;

(B) at least one beverage dispensing head supported by the cabinet to discharge beverage therefrom in a path of flow induced by gravity;

(C) means including a spill trough in the cabinet having an angled, perforated surface to support a succession of containers to be filled on said cabinet a sufficient distance from each dispensing head that the possibility of contact of the container with the dispensing head during placement of the container on and removing it from said means is negligible and at an angle with respect to the free path of flow of beverage discharged from said dispensing head, and bracket means fixed to the cabinet to hold the container in its angled position and to hold the filling opening to the container out of the path of flow of the beverage discharged from the dispensing head; and (D) sanitary disposable paper means adapted to be placed between the dispensing head and the filling opening in the container to conduct beverage discharged from the dispensing head and for directing said beverage into the filling opening of the container in filling position.

4. A beverage dispenser as in claim 3, wherein the sanitary disposable paper means comprises a funnel.

5. A beverage dispenser comprising:

(A) a cabinet;

(B) at least one beverage dispensing head supported by the cabinet to discharge beverage therefrom in a path of flow induced by gravity;

(C) means to position a container having a filling opening, which may be contaminated, on the cabinet a sufficient distance from the beverage dispensing head that the possibility of contact of the container with the dispensing head during placement of the container on and removing it from said means is negligible; and (D) sanitary disposable paper means having a size and shape permitting it to conduct beverage discharged from the dispensing head into the filling opening of said container in filling position.

6. A beverage dispenser as in claim 5, wherein the sanitary disposable paper means comprises a funnel.

7. A beverage dispenser as in claim 5, wherein the means to position a container on the cabinet comprises a spill trough in the cabinet having an angled perforated surface to support the container with its axis at an angle with respect to the path of flow of beverage discharged from the dispensing head.

8. A beverage dispenser as in claim 7, wherein the sanitary disposable paper means comprises a funnel.

9. A beverage dispenser as in claim 7, including a plurlity of beverage dispensing heads, and wherein the spill trough is adapted to position a plurality of containers to receive beverage from the dispensing heads.

* * * * *